US007073793B2

(12) United States Patent
Vancura

(10) Patent No.: US 7,073,793 B2
(45) Date of Patent: Jul. 11, 2006

(54) SYSTEM AND METHOD FOR SURVEY-BASED BONUS GAME

(75) Inventor: Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 69 days.

(21) Appl. No.: 10/643,429

(22) Filed: Aug. 19, 2003

(65) Prior Publication Data

US 2004/0036216 A1 Feb. 26, 2004

Related U.S. Application Data

(63) Continuation of application No. 09/372,560, filed on Aug. 11, 1999, now Pat. No. 6,988,732.

(60) Provisional application No. 60/099,959, filed on Sep. 11, 1998.

(51) Int. Cl.
*A63F 1/00* (2006.01)

(52) U.S. Cl. ..... 273/274

(58) Field of Classification Search ..... 463/1, 463/9–11, 13, 16–20, 25, 30; 273/138.2, 273/139, 274, 292, 143 R, 429–432
See application file for complete search history.

(56) References Cited

U.S. PATENT DOCUMENTS

| | | | | |
|---|---|---|---|---|
| 4,836,546 | A | 6/1989 | DiRe et al. | |
| 5,178,545 | A * | 1/1993 | Thompson | 434/335 |
| 5,218,631 | A | 6/1993 | Katz | |
| 5,342,049 | A | 8/1994 | Wichinsky et al. | |
| 5,377,973 | A | 1/1995 | Jones et al. | |
| 5,393,057 | A | 2/1995 | Marnell, II | |
| 5,456,607 | A | 10/1995 | Antoniak | |
| 5,673,917 | A | 10/1997 | Vancura | |
| 5,718,429 | A * | 2/1998 | Keller, Jr. | 273/274 |
| 5,743,800 | A | 4/1998 | Huard et al. | |
| 5,882,261 | A * | 3/1999 | Adams | 463/20 |
| 6,047,963 | A * | 4/2000 | Pierce et al. | 273/121 B |
| 6,155,925 | A * | 12/2000 | Giobbi et al. | 463/20 |
| 6,159,097 | A * | 12/2000 | Gura | 463/20 |
| 6,190,255 | B1 * | 2/2001 | Thomas et al. | 463/20 |
| 6,193,606 | B1 * | 2/2001 | Walker et al. | 463/20 |
| 6,203,429 | B1 * | 3/2001 | Demar et al. | 463/20 |
| 6,331,144 | B1 | 12/2001 | Walker | |

FOREIGN PATENT DOCUMENTS

| | | |
|---|---|---|
| GB | 2 066 991 A | 7/1981 |
| GB | 2 087 618 A | 5/1982 |
| GB | 2 113 881 A | 8/1983 |
| GB | 2 167 676 A | 6/1986 |
| GB | 2 184 029 A | 6/1987 |
| GB | 2 185 612 A | 7/1987 |

(Continued)

OTHER PUBLICATIONS http://www.familyfeud.tv/history.html, "Feud History" of the Family Feud, 2002.*

(Continued)

*Primary Examiner*—William M. Pierce
(74) *Attorney, Agent, or Firm*—McDermott Will & Emery LLP

(57) ABSTRACT

A method for a survey-based casino game. A first embodiment provides the survey-based casino game as a bonus game for an underlying casino game. A second embodiment provides a stand-alone survey-based casino game and a third embodiment provides back-and-forth play between a casino game and a survey-based casino game.

17 Claims, 6 Drawing Sheets

FOREIGN PATENT DOCUMENTS

| | | | |
|---|---|---|---|
| GB | 2 188 182 | A | 9/1987 |
| GB | 2 197 974 | A | 6/1988 |
| GB | 2 201 822 | A | 9/1988 |
| GB | 2 207 268 | A | 1/1989 |
| GB | 2 216 322 | A | 10/1989 |
| GB | 2 217 500 | A | 10/1989 |
| GB | 2 253 569 | A | 9/1992 |
| GB | 2 262 642 | A | 6/1993 |
| GB | 2 292 246 | A | 2/1996 |
| WO | WO 98/09259 | | 3/1998 |

OTHER PUBLICATIONS

Win95 Games: Cards & Gambling web site at: http://www.aclass.com/WOFT/gamese.html, "Slots of Trivia", see entire disclosure, 17 pages.

International Search Report, 3 pages, Dec. 23, 1999.

Regulations of the Nevada Gaming Commission, Carson City, Nevada, Nov., 1998 pp. 953-954.

Butterworths Annotated Legislation Service, Statutes Supplement No. 171, The Gaming Act 1968, Eddy and Loewe, London, 1969, pp. 209-212.

Machine Guidelines Jul. 99, www.gbgb.org.uk/consol.htm, Feb. 7, 2001, pp. 1-11.

Olaf Vancura, Ph.D., Chapter 2—How Do Casinos Make Money?, Smart Casino Gambling—How to Win More and Lose Less, pp. 23-33, Index Publishing Group, Inc., San Diego, California.

Ruben Martinez, Managing Casinos—A Guide for Entrepreneurs, Management Personnel and Aspiring Managers, pp. 40-43, Barricade Books, New York.

Jim Kilby and Jim Fox, Chapter 7—Slot Management and Chapter 13—Table Game Hold as a Management Tool, Casino Operations Management, pp. 103-125 and 213-225, John Wiley & Sons, Inc., New York.

Casino Operations Management, by Jim Kirby and Jim Fox, John Wiley & Sons, Inc., New York, pp. 197-229 and 321-332, 1998.*

Scarne's Complete Guide to Gambling, by John Scarne, Simon and Schuster, New York, pp. 16-21 and 330-339, 1961.*

Scarne's Complete Guide to Gambling, by John Scarne, Simon and Schuster, New York, pp. 325-329, 343, 396-403, 1961.*

* cited by examiner

SYSTEM AND METHOD FOR SURVEY-BASED BONUS GAME

RELATED APPLICATION

This application is a continuation of U.S. application Ser. No. 09/372,560 filed on Aug. 11, 1999 now U.S. Pat. No. 6,988,732 entitled KNOWLEDGE-BASED CASINO GAME AND METHOD THEREFOR which application claims priority to U.S. Provisional Application Ser. No. 60/099,959 filed on Sep. 11, 1998 entitled KNOWLEDGE-BASED CASINO GAME AND METHOD THEREFOR.

BACKGROUND OF THE INVENTION

1. Field of the Invention

The present invention relates to casino games and, in particular, to casino games utilizing a player's knowledge as part of the game play.

2. Statement of the Problem

Casino games of chance presently fall into two categories—those that incorporate an element of skill, either in the betting or the playing, and those that do not. Many casino games of chance have some element of skill with respect to betting. For example, in Craps, some wagers have a house advantage of about 1%, while others have a house edge of nearly 17%. Clearly, the player will fare better, in the long run, avoiding wagers with a huge house advantage. Generally, any casino game of chance offering a variety of player expectations based on wagering has an element of betting skill involved. So, too, a player will fare better (for appropriate games) utilizing a good playing strategy. Examples of conventional casino games of chance in which playing skill is a major factor include Blackjack, Poker, and many card games in which the player has a unique hand.

While casino games of chance with an element of skill are plentiful, "skillful" play does not necessarily imply short-run success. For example, in Blackjack, the proper play when holding a "twelve" vs. a dealer "seven" is to hit. However, if the dealer hit card is a "ten," then the player busts and loses the wager. Similarly, all existing skill-based games retain an element of chance such that a "correct" play will sometimes be penalized, whereas an "incorrect" play will sometimes be rewarded. All of these casino games of chance relate to a player's skill of game play, rules, and statistical odds.

A number of well known conventional consumer games using a player's knowledge exist such as JEOPARDY. JEOPARDY is such a knowledge-based game wherein players win money based upon their knowledge of the answer to a question. In a typical round, a question is put to three players and the first to respond with the correct answer wins an amount of money which is displayed in front of the player. In the FINAL JEOPARDY round, a player may wager an amount of money, in the complete discretion of the player, from the accumulated winnings on having the correct answer to a question. The player writes the answer down and, if correct, receives the amount wagered which is added to the accumulated winnings. If the player is wrong, the amount wagered is deducted from the accumulated winnings. JEOPARDY represents a consumer game show wherein a player, simply using knowledge, plays to win money and in the FINAL JEOPARDY round can actually wager that money. Such consumer game shows as JEOPARDY, FAMILY FEUD, THE PRICE IS RIGHT, etc. are designed to always pay out money to the players. Such game shows earn a profit from advertising and merchandising revenues, but the actual games are designed to always pay out money. Furthermore, players upon starting the game are not required to ante up a wager or a bet as is commonly found in a casino.

Patent Cooperation Treaty International Publication Number WO 98/09259 provides a tic-tac-toe (or games such as Battleship or Concentration) casino game where a player may play against a machine or another player. In tic-tac-toe, a video screen displays touch sensitive areas. The player inserts 1 to 5 credits and presses a gamble button. The player then touches an image element on the screen and a large X is placed at that element as well as a prize indicia. The machine then selects an image element and places a large zero. This process continues. When the machine wins tic-tac-toe, the player loses the bet. When the player wins the tic-tac-toe, the machine pays the player the sum of the prize indicia in each image element multiplied by the number of credits bet. It is well known that the game of tic-tac-toe, with optimal play on the part of the participants, will necessarily result in a draw. Hence the Ser. No. 98/09259 patent requires, for the player to win as is taught, the computer opponent must play randomly, or at least occasionally play suboptimally (otherwise, the player would never win). A player who knows how to play tic-tac-toe and who would normally win, therefore, is not assured of success. Furthermore, the use of random "go again" or "lose a turn" squares ensures that the outcome of the game remains random (i.e., a game of chance) as opposed to deterministic.

A continuing need exists to provide new and exciting casino games. Having the opportunity to test a player's knowledge of trivia, facts, surveys, pricing, and so forth independent of a player's skill in a game of chance would be a welcome addition to the casino experience. Also, the use of knowledge serves to add an element of teamwork to the casino game, as patrons will ask colleagues and other participants for assistance if in doubt. A need exists to provide a knowledge-based casino game.

SUMMARY OF THE INVENTION

A method for a casino game is presented. In a first embodiment of the method, a knowledge-based bonus game is provided in combination with an undedying game of chance. A wager is received from a player to play both the underlying game of chance and potentially the knowledge-based bonus game. The underlying game of chance is played and the underlying game of chance has a first house advantage based upon the received wager. Play of the knowledge-based bonus game occurs at a given statistical frequency. After the knowledge-based bonus game is played, the underlying game of chance is restarted. In this embodiment, the combined knowledge-based bonus game with the underlying casino game has a second house advantage which is acceptable to the house even when the player has perfect knowledge of all answers in the knowledge-based bonus game. In a second embodiment, the knowledge-based bonus game is a stand-alone casino game. The knowledge-based bonus games whether as a bonus or stand-alone casino game are designed to maintain the house advantage in a range from when all answers to all queries in the knowledge-based bonus game are always correct from the player to the other extreme when all answers to all queries in the knowledge-based bonus game are always being guessed at by the player. In a third embodiment, a knowledge-based casino game is played in a back-and-forth arrangement with another casino game of chance.

DETAILED DESCRIPTION OF THE INVENTION

Figure 1:
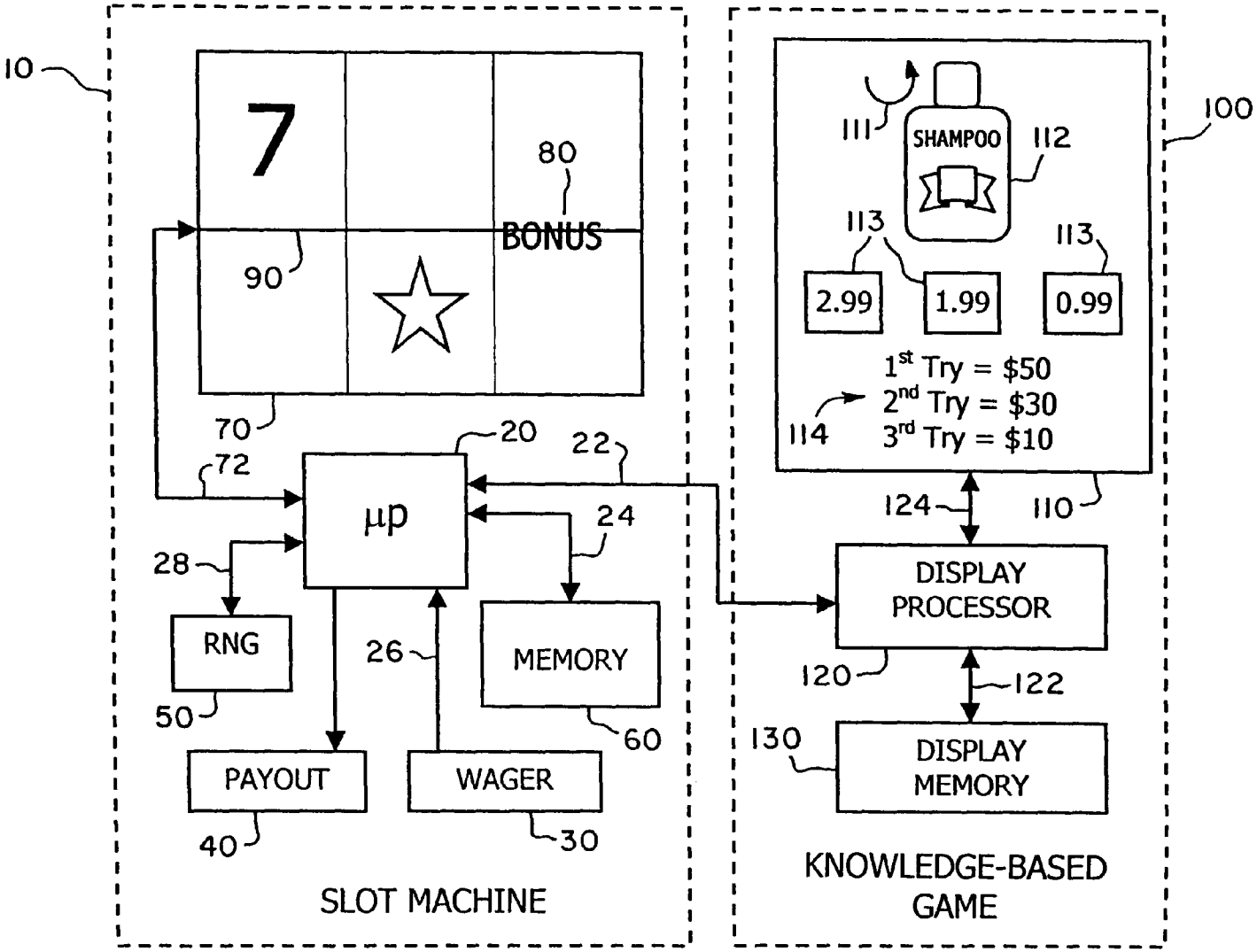
FIG. 1 is a block diagram representation of the knowledge-based bonus game adapted to play a game based upon the prior art game of THE PRICE IS RIGHT.

1. Overview.

Throughout this disclosure the term "game of chance" shall refer to all types of conventional gambling games (whether live or automated) based on a wager(s) placed by a player whether or not the game is physically located in a casino or remote therefrom. Indeed such games of chance can be implemented on-line or on the Internet. "Skill" is defined herein to be a decision (in betting, playing, or both) such that long term performance in the play of a game of chance is maximized. On an individual game of chance basis, however, adopting "skillful" play may or may not yield a desired result, as an element of randomness remains. An example is the decision of how to play the hand of blackjack described above in the Statement of the Problem.

"Knowledge" is defined herein to be a decision which, on an individual game basis, necessarily yields a result without any element of chance. An example is the decision of how to respond to the question "Which is the smallest U.S. state?" Clearly, a correct answer has no associated uncertainty. The following disclosure provides a new casino game using the knowledge a player has and, therefore, the term "knowledge-based" casino game is used throughout. Because a knowledge-based casino game presents a risk of loss to the casino from those players "in the know," a special set of circumstances must be constructed to maintain game viability from a house advantage point of view.

Consider the following example of a trivia knowledge-based game which is ill-advised to incorporate into a casino environment: A player wagers 1 coin and is presented with a knowledge-based question (i.e., query) and 5 possible answers—one of which is correct. The player chooses an answer and should the player be correct, the player is paid 4 coins (i.e., a win of 3 coins), however should the player be incorrect, the player is paid nothing (i.e., a loss of 1 coin). With perfect knowledge, the player's expectation under this example is +300% which is disastrous for a casino. The preceding example serves to show why a casino knowledge-based game needs to be carefully constructed.

The present invention herein provides a knowledge-based casino game, but in one embodiment, keeps the associated expected return (from the knowledge-based portion) sufficiently small so that even a player with perfect knowledge will not be able to gain an advantage over the house (i.e., to limit the player's winnings). Additionally, the invention provides that a player with no knowledge will be able to play a game without a prohibitively high house advantage (i.e., to limit a player's losses). Alternatively, the game can be constructed with sufficiently small knowledge-based expected return so that perfect knowledge results in only a known advantage over the house. For example, in conventional video poker, paytables are often constructed such that with perfect skill, the player can squeak out a modest advantage of roughly 1%. However, the average player still plays at a considerable disadvantage, hence the casino still profits from play of these machines.

The present invention provides a knowledge-based game wherein the player's expectation, in the case of a player with perfect knowledge, is set at a value not to exceed an amount that maintains an acceptable house advantage to the casino. In addition, in the play of the knowledge-based casino game of the present invention, the player's expectation for players with imperfect knowledge and who simply guess falls within a range of house advantage values set into the design of the game under the teachings obtained herein.

As will be discussed in the following, the knowledge-based casino game of the present invention finds use as a bonus game to a conventional underlying casino game of chance, as a stand-alone casino game, and as a casino game that interacts with a conventional casino game of chance in a "back and forth" relationship. Furthermore, any type of knowledge-based consumer game or other game based upon knowledge can be adapted, under the teachings of the present invention, into the casino game of the present invention.

In the following examples of conventional knowledge-based games such as THE PRICE IS RIGHT, The FAMILY FEUD, TRIVIAL PURSUIT, multiple choice, proximate choice, and puzzles are used to illustrate how the methods of the present invention enable such games to be played in a casino wherein the casino is protected against a player with perfect knowledge and the player is protected when simply guessing.

2. Knowledge-based Bonus Game

A knowledge-based casino game, under the teachings hereof, works well as a bonus game to a conventional underlying casino game of chance. Consider the following knowledge-based bonus game on an underlying conventional slot machine. The slot machine can be a standard stepper-reel or video-reel which has a bonus feature. Without loss of generality, assume that with X units wagered in the underlying game, the player is eligible for the bonus game with frequency, f. The frequency, f, may periodically occur (e.g., every 20 games) or may be entirely random with a statistical frequency over time (e.g., on average every twenty games, but randomly selected). The expected return is R units for the underlying casino game of chance without the bonus, and the bonus participation, on average, garners B units. The house advantage may be written as:

$$\text{House Advantage} = -[R + fB - X]/X \qquad \text{FORMULA 1}$$

Where:

R=Player's Expected Return for Underlying Game in Units f=Frequency

B=Player's Expected Return for Bonus Game in Units

X=Units Wagered

Of course, the following is true:

$$\text{Player's Expectation} = -\text{House Advantage} \qquad \text{FORMULA 2}$$

When used as a bonus or as a part of a game, the means of initiating the bonus or entering the part of the game is not material to this invention. Any condition occurring in the underlying game of chance can be utilized. There are a large number of bonus game initiation mechanisms that are variously triggered upon the occurrence of an event in the underlying game. For example, in the case of reel slot machines, a special bonus pay symbol (or combination of existing symbols) could align on the payout line (or elsewhere in the window) of the slot machine. Or, any other suitable game event could be utilized such as the occurrence of a random event such as selecting a random number for coin-ins and signaling the condition when the random-numbered coin-in occurs. Any condition occurring, but unrelated to the game play can also be utilized such as a randomly set timer. Furthermore, while the condition preferably causes the underlying game of chance to stop so that the knowledge-based bonus game can be played, certain embodiments of the present invention continue play of the underlying game of chance while the player plays the knowledge-based bonus game.

In addition, the play of the knowledge-based bonus game could also require an extra wager. For example, when the condition occurs in the underlying game of chance, the player would have a choice to wager an additional amount to play the knowledge-based bonus game or to continue play of the underlying game of chance. The teachings of the present invention are not limited by the condition in which the underlying game of chance triggers, causes, initiates, or trips the knowledge-based bonus game. The knowledge-based bonus game, as defined above, and the use of the formulas described above (or something similar) determines the limiting cases of perfect knowledge and no knowledge on the part of the player. Indeed, the exact algorithmic game model of the knowledge-based game could be one of many possibilities, some of which will be discussed later.

Two examples follow which illustrate the teachings of the knowledge-based bonus game of the present invention.

EXAMPLE 1

For example, consider a slot machine in which the player (with a maximum bet, X, of 3 units) is eligible for a knowledge-based bonus game of the present invention with frequency, f, of 0.02 (i.e., 1 in every 50 spins). Furthermore, the expected return R on the conventional underlying casino game is 2.4 units (80%). A player may have perfect knowledge or a player may simply guess the answers to the knowledge-based bonus game. For the player simply guessing, assume a desired House Advantage of roughly 8% (i.e., Player's Expectation=−8%). Solving Formula 1, the desired $B_{MIN}$=18 units. $B_{MIN}$ is a first value for a player's expected return from pure guessing. For the player with perfect knowledge, a desired "worst case" scenario is no House Advantage or 0%. Setting the House Advantage equal to 0% yields in Formula 1, a $B_{MAX}$=30 units. $B_{MAX}$ is a second value for a player's expected return for always being correct. Further assume the following algorithmic game model for the knowledge-based bonus casino game of this example:

The player is asked a knowledge-based question and given 2 possible responses. The player must select a response. If correct, the player is awarded 30 units. If incorrect, the player is awarded 6 units.

The following considerations are possible for this example. A player with perfect knowledge will always answer correctly and will have an expected win, $B_{MAX}$, for the bonus game=30 units. This player's expectation (and the House Advantage) will be 0% for the entire game. On the other hand, a player that knows none of the answers will guess correctly one-half the time, and incorrectly one-half the time. This player's expected win, $B_{MIN}$, for the bonus game is ½(6)+½(30)=18 units, leading to a player's expectation of −8% (house advantage of +8%), as desired, for the entire game. The casino is thereby assured of a statistical House Advantage in a range having an upper limit and a lower limit.

Note that these two types of players represent the two extremes in terms of the knowledge-based casino game design of the present invention. All other players, with perhaps knowledge of some of the answers, or some knowledge of the answers, will have player expectations that fall, in this example, between the two extremes of 0% and −8%. Or, house advantages in the range of 0% (for perfect knowledge players) to 8% (for players who simply guess). It is assumed that a player will try to maximize his/her expected return, B, in the play of the bonus game. It is to be expressly understood that it is possible for a perfect-knowledge player to purposely attempt to miss every knowledge-based question, in which case the house advantage would be 16%.

The actual values of 0% and −8% in this example are mere illustrations based on the two types of players: a player with perfect knowledge and a player with no knowledge (i.e., a player simply guessing). All other players will fall somewhere in the middle of the range. The "average" house advantage for the combined underlying game of chance and knowledge-based bonus game will fall somewhere in the middle of the range dependent upon the knowledge of the player.

In Example 1, the player, in the knowledge-based game always wins: if correct 30 units or if incorrect 6 units. However, the house is protected with the assurance that over time in the play of the combined underlying game of chance and knowledge-based bonus game, that the house advantage is 0% whenever a player with perfect knowledge plays the game. At this point, it is clear that the instantaneous house advantage varies on the knowledge that the player has in playing the knowledge-based bonus game. The house is assured, in this example, that over time it will never lose money (when 0% is set as the House Advantage limit value for a player with perfect knowledge).

To illustrate a variation of the above example, based on a separate wager for the bonus game, keep everything the same except that the player needs to wager 3 units to play the bonus game. Instead of paying 30 units for a correct answer and 6 units for an incorrect answer, award 33 units for correct and 9 units for incorrect. Bmax=33−3=30 units as before; Bmin=½(33)+½(9)−3=18 units, as before. Thus, we have the same overall house advantage as before; the bonus game awards are modified to reflect the "price" of participating in the bonus.

EXAMPLE 2

As another example, consider the same underlying slot game as in the example above with a different knowledge-based bonus game in which the following algorithmic game model is used:

The player is asked a question and given five possible responses. The player must select a response. If correct, the player is awarded 25 units. If incorrect, the player is awarded another selection from among the four remaining responses. If now correct, the player is awarded 20 units. If again incorrect, the player is awarded 10 units.

For this example, the following considerations apply. A player with perfect knowledge, who knows all of the answers, will have a player's expected return of $B_{MAX}$=25 units which results in an overall Player's Expectation of −3.33%, or House Advantage=−[2.4+0.02 $B_{MAX}$−3]/3=3.33%. A player that simply guesses responses and knows nothing will have a player's expected return of $B_{MIN}$=⅕(25)+⅕(20)+⅗(10)=15 units resulting in an overall Player's Expectation of −10%, or House Advantage=−[2.4+0.02$B_{MIN}$−3]/3=10%. Again, these two types of players (i.e., perfect knowledge players and players who simply guess) represent the extremes in this example. The actual house advantage (representing a mixture of player types, and hence knowledge) will lie in the range of 3.33% and 10%. Again, the overall house advantage against a player with perfect knowledge does not drop below 3.33% in this example, thereby protecting the house. Note that there is a guaranteed non-zero house advantage in this example which differs from the first example. That is, even with a perfect knowledge player, the house will realize a House Advantage of +3.33%.

EXAMPLE 3

The following example illustrates the many possibilities for varying the frequency, f, of the knowledge-based bonus game occurrence, the expected return, R, for the underlying game without the bonus, and the wager, X, that the player makes.

Consider a 3-unit (X=3) game in which the desired constraints are $PE_{MIN}$=−15% (i.e., Maximum House Advantage=15%), $PE_{MAX}$=0% (i.e., Minimum House Advantage=0%).

$$PE_{MIN}=[R+fB_{MIN}-X]/X \quad \text{FORMULA 3}$$

Where:

$PE_{MIN}$=the Minimum Player's Expectation in % Units $$PE_{MAX}[R+fB_{MAX}-X]/X \quad \text{FORMULA 4}$$

Where:

$PE_{MAX}$=the Maximum Player's Expectation in % Units

The solutions for $B_{MIN}$ and $B_{MAX}$ as a function of R/X (the return per unit wager) are:

$$B_{MIN}=[PE_{MIN}-R/X+1]\times X/f \quad \text{FORMULA 5}$$

$$B_{MAX}=[PE_{MAX}-R/X+1]\times X/f \quad \text{FORMULA 6}$$

Table I summarizes the values of $B_{MIN}$ and $B_{MAX}$ as a function of various values of R/X and f. The matrix entries are in the form $B_{MIN}$, $B_{MAX}$.

TABLE I

| | R/X | | | | |
|---|---|---|---|---|---|
| f | 0.6 | 0.65 | 0.7 | 0.75 | 0.8 |
| 0.01 | 75, 120 | 60, 105 | 45, 90 | 30, 75 | 15, 60 |
| 0.015 | 50, 80 | 40, 70 | 30, 60 | 20, 50 | 10, 40 |
| 0.02 | 37.5, 60 | 30, 52.5 | 22.5, 45 | 15, 37.5 | 7.5, 30 |

TABLE I-continued

| | R/X | | | | |
|---|---|---|---|---|---|
| f | 0.6 | 0.65 | 0.7 | 0.75 | 0.8 |
| 0.025 | 30, 48 | 24, 42 | 18, 36 | 12, 30 | 6, 24 |
| 0.03 | 25, 40 | 20, 35 | 15, 30 | 10, 25 | 5, 20 |

Thus, for a given f, R, and X, the corresponding values for $B_{MIN}$, $B_{MAX}$ will yield the desired minimum House Advantage (a player with perfect knowledge) of 0% and maximum House Advantage (a player with no knowledge) of 15%.

In Table I, paying units in fractional values out to players would not be desirable; and hence, if $B_{MIN}$, $B_{MAX}$ are fixed at integer values for every bonus game, the f=0.02 value would be avoided in the design process. However, all of the other entries in Table I are integer values for $B_{MIN}$, $B_{MAX}$ and, hence, if fixed integer values are desired for every bonus game, would represent desirable payouts. For example in Table I, where R/X equals 0.8 (that is an 80% return to the player over time), any of a number of suitable bonus game frequencies, f, could be utilized. For example: assume f equals 0.03 (or the occurrence of the bonus game is three times out of every one hundred spins of a slot game), this results in a $B_{MIN}$=5 units and a $B_{MAX}$=20 units. Clearly if the occurrence of a bonus game is f=0.01 (or once every one hundred spins of the underlying slot game), the payoff to the player is higher since $B_{MIN}$=15 units, and $B_{MAX}$=60 units. Table I is provided as illustration of many possible design parameters based upon f, R, and X as well as $B_{MIN}$, $B_{MAX}$ which will result in the house advantage for a perfect player of 0% and a maximum average house advantage of 15% for a player who simply guesses, for the overall combined underlying and bonus game. Again, the underlying house advantages can be any suitable range worked into the design of the overall game of the present invention.

The values for $B_{MAX}$ and $B_{MIN}$ need not be fixed, hence identical, for every visit to the bonus game. Rather, it can vary. Consider a game with $B_{MAX}$=50 randomly half the time, and $B_{MAX}$=100 randomly half the time. In this case, the overall $B_{MAX}$=75 units, and this overall or average value may be substituted in the formalism above for $B_{MAX}$ (similarly for $B_{MIN}$). While a random variation can occur, such a variation may also be timed to attract players to machines during otherwise slow period.

What has been presented in the above three examples is a method for playing a knowledge-based bonus game in combination with an underlying casino game wherein a player places a wager, X, to play both the underlying casino game of chance and the knowledge-based game. The player plays the underlying casino game of chance having a predetermined player return, R. A ratio R/X exists which is well known in the casino industry when applied to the underlying game of chance as a whole. The method of the present invention provides a knowledge-based bonus game which could be any suitable algorithmic game model as a bonus game in combination with an underlying game such as a slot machine. The knowledge-based bonus game occurs at a frequency, f, wherein the underlying game of chance is stopped and the player has the opportunity to use his/her knowledge to play the knowledge-based bonus game. The frequency, f, is preferably randomly selected so that on average it occurs at a known rate over time. In the preferred embodiment, rewards, awards, or payouts are always made whether or not the player has the correct response in the knowledge-based game. This preferable approach encourages players to continue to play the underlying slot games even though they are not always correct in their responses. It is to be expressly understood that the method of the present invention is not limited to the preferred approach and, for example, that players with incorrect responses could receive nothing.

For example, consider a knowledge-based game in which for a query, five responses are given, three of which are valid and two of which are incorrect. The player is awarded 30 units for each valid answer. The game ends when an invalid answer is given, or after all three valid answers are chosen which garners a 20 unit bonus. A player in this variation with perfect knowledge will earn 110 units per bonus game. A player with no knowledge has a $\frac{3}{5}\times\frac{2}{4}\times\frac{1}{3}=\frac{1}{10}$ chance of getting all three correct answers, a $\frac{3}{5}\times\frac{2}{4}\times\frac{2}{3}=\frac{1}{5}$ chance of getting two correct answers, a $\frac{3}{5}\times\frac{2}{4}=\frac{3}{10}$ chance of getting one correct answer, and a $\frac{2}{5}$ chance of getting no correct answers. Thus the no-knowledge player's expected return is $\frac{1}{10}\times110+\frac{1}{5}\times60+\frac{3}{10}\times30+\frac{2}{5}\times0=32$ units per bonus game. Of course, many variations are possible under this example.

Under the method of the present invention, the casino is assured that when a player with perfect knowledge plays the knowledge-based bonus game in conjunction with an underlying casino game of chance, that its house advantage value will be preserved over time so as not to fall below a predetermined amount. In the preferred embodiment, the predetermined amount is nonnegative, but it is to be understood that in certain designs of the present invention, the minimum house advantage could be set at any suitable positive, zero, or negative value dependent upon the nature of the game and the desires of the casino. Finally, in the preferred embodiment of the present invention, the knowledge-based casino bonus game used in conjunction with an underlying casino game of chance provides a House Advantage that exists in a range from a first House Advantage corresponding to correct responses from a player with perfect knowledge to a second House Advantage corresponding to responses that are simply guessed by a player who has no knowledge. The provision of such a range ensures fairness to the house and to the players so as to prevent a player with perfect knowledge or a team of players working together from cleaning out or bankrupting the house. In the preferred embodiment, the house advantage range is from about −3% to about +20%. While this is the preferred range, it is not meant to limit the teachings of the present invention.

While the term "units" are used in the above examples (and subsequently), it is to be understood that units could be, but not limited to, coins, bills, credits, charges, tickets, or any form of wager or bet.

The following represent illustrative examples of implementing several well-known knowledge-based games, under the teachings of the present invention, as bonus games into well-known underlying casino games of chance. In no way should these examples be interpreted to limit the scope of the invention. Indeed, they are meant to indicate some of the possibilities under the teachings of this invention.

3. Knowledge-Based Bonus Casino Games Based Upon Conventional Game Shows

Three examples follow, using the teachings of the present invention to modify conventional knowledge-based game shows into casino environments.

a. THE PRICE IS RIGHT Gameshow Example

In this example, a slot machine is conventionally playing with a bonusing feature under the teachings of the present invention. Periodically, the player gets to participate in a knowledge-based bonus game based upon the conventional THE PRICE IS RIGHT game. It is to be expressly understood that no endorsement, affiliation or relationship whatsoever exists between the owners of THE PRICE IS RIGHT game show and the inventor and/or assignee of the present invention. THE PRICE IS RIGHT trademark and game is used in a factual sense to illustrate the teachings of the present invention.

In the play of THE PRICE IS RIGHT game show, an object is displayed on a screen and a description (oral or written) is given. The player is shown three prices and is given two chances at guessing the correct price. If the player is correct on the first guess, the player receives a high payoff, a lower payoff if correct on the second guess, and lower still if the player misses with both guesses. For example, a bottle of shampoo is shown in three-dimensional rotation on the screen while being described verbally in a multi-media presentation. Thereafter, three prices (e.g., $2.99, $1.99, $0.99) are shown and the player tries to choose the correct price.

In FIG. 1 is shown a standard slot machine 10 interconnected to the knowledge-based game 100 of the present invention. The slot machine 10 is conventional and may comprise a number of different designs. The block diagram hardware components of such a slot machine 10 as shown in FIG. 1 are illustrative only and include a microprocessor or computer or controller 20 interconnected to a device 30 for receiving bets or wagers from players. The device 30 can be of any suitable design or construction and can be for example, but not limited to, a bill reader, coin acceptor, credit device, credit card reader, ticket reader, smart card reader, debit card reader, or any combination thereof. How a wager is received in device 30 is immaterial to the teachings of the present invention. In live casino games of chance such as live card games, wagers would be received by the casino from the player. The microprocessor 20 is also connected to a payout device 40 which could be for example, a coin dispenser or a device for delivering information to a smart card. How a payout or award is made is also immaterial to the present invention. The microprocessor 20 is usually connected to a random number generator 50 which may be a separate hardware component or a software module within suitable memory. The microprocessor 20 is also interconnected to memory 60 and to slot reels 70. Slot machine 10 is shown in functional block diagrams and conventional busses, buffers, etc. are not shown.

The operation and design of gaming machines of chance are well known and the present invention can be adapted to operate with any conventional gaming machine. The conventional slot machine 10 is modified to have a bonus condition such as the bonus symbol 80 on payline 90. The provision of a bonus symbol 80 on the payline 90 is also conventional and it is well known that slot machines 10 can have a bonus condition randomly appear which results in a player having the opportunity to play a bonus game. In FIG. 1, the microprocessor 20 over line 22 delivers the bonus condition to the knowledge-based game 100 of the present invention. When a player receives the bonus condition 80 on the payline 90, which may be any suitable bonus condition, slot machine 10 becomes inactive (i.e., stops) and the player's attention is directed to the bonus game 100. Line 22 can carry an electrical signal (or signals) or can be a mechanical linkage.

It is to be expressly understood that the underlying game of chance can be any suitable casino game of chance and is not limited to a slot machine 10 (nor to the design of FIG.

1). Any underlying game such for example, as a video poker machine, big wheel, table games (with or without associated hardware), keno machines, could issue a bonusing signal on line 22 to deactivate (or stop) the underlying game of chance so that a player can play the knowledge-based bonus game of the present invention. It is to be expressly understood that any of a number of equivalent approaches for generating a bonus condition and for communicating the presence of the bonus condition in the underlying machine 10 can also be utilized including but not limited to electrical, mechanical, or optical transmissions.

In FIG. 1, the bonus game of the present invention based upon the conventional THE PRICE IS RIGHT game is shown to the player in a video display 110. In the example above, the bottle of shampoo 112 is shown which can rotate in three dimensions as shown by arrow 111. Prices are displayed on touch screen areas 113. A payout chart 114 is also displayed which may be on the monitor 110 or separate therefrom. The player has three tries in which to obtain a bonus payout.

In FIG. 1, a display processor 120 is interconnected to a display memory 130 which selectively displays separate images in the video monitor 110. The display memory 130 contains a large database of objects and accompanying prices for display in the display monitor 110. In a preferred embodiment, upon entering a bonus game, an object is randomly chosen from the entire database 130. Alternately, database 130 can be arranged so that after each display the item and prices displayed are destroyed so that it will not appear again. Or, the database in memory is so large (for example, 10,000 items) that the database record would be added to the end of a sequential stack so that 10,000 displays would occur before being redisplayed. Or, the "just displayed" image could be randomly inserted into the database memory so as not to be predictable. In addition, the remaining or alternate responses could be generated "on the fly." For example, in FIG. 1 the correct answer is $0.99, then alternate responses could be generated by the computer based on the known answer in a number of ways, too numerous to mention. For example, randomly select two prices between x and y of the actual price, round up to the actual price, and ensure that the actual price is not duplicated. For example, choose x equal to ½ of the actual price and y equal 1½ of the actual price, and if the actual price is $0.99, round up to the nearest $0.09. Alternately, the values x and y may also be randomly selected, etc.

How the database is constructed is immaterial to the teachings of the present invention. The database would need, at a minimum, the questions and correct responses. Other possible answers can either be in the database or generated "on the fly" as described above. It is also to be expressly understood that the display monitor 110 and the use of touch screens 113 are illustrative of the present invention and that many other equivalent approaches could be utilized. For example, the touch screen areas 113 could be dedicated push buttons located below the monitor 110, or a keyboard, or voice commands could be utilized. Indeed, the monitor 110 displays the information and could be used in conjunction with an audio presentation. The present invention is not to be limited to how the knowledge-based questions are answered, whether or not an audio, or visual presentation (or a combination thereof) is made.

Furthermore, it is to be expressly understood that the knowledge-based game 100 while shown as a separate component in FIG. 1 could be implemented into the slot machine 10 control electronics. In which case, the microprocessor 20 in the underlying game would be capable of performing the functions of the display processor 120. This results in savings in the construction of the game.

In the following example, consider a 3-coin "buy-a-pay" slot machine. The first two coins have a return of 90% each and do not render the player eligible for the bonus game. The third coin has no base game pays except to make the player eligible for a "PRICE IS RIGHT" bonus game with frequency f=0.02. In this "buy-a-pay" configuration, R/X=1.8/3=0.6.

If the casino desires a minimum House Advantage of 4% and maximum house advantage of 12%, then using Formulae 5 and 6:

$$B_{MIN}=(-0.12-0.6+1)\times 3/0.02=42 \text{ coins}$$

$$B_{MAX}=(-0.04-0.6+1)\times 3/0.02=54 \text{ coins}$$

Thus, for example, the knowledge-based game 100 may present three prices in display 110 and have the player select one price. If the player is correct on the first guess, the award may be 54 coins. If correct on the second guess, the award may be 42 coins, and if incorrect on both guesses, the award may be 30 coins. In this case, $B_{MAX}$ is equal to 54 coins. The player with no knowledge has a ⅓ chance of being correct on the first guess, a ⅓ chance of being correct on the second guess, and a ⅓ chance of missing both guesses. Hence, $B_{MIN}=\frac{1}{3}(54)+\frac{1}{3}(42)+\frac{1}{3}(30)=42$ coins. Under this example, the PRICE IS RIGHT knowledge-based game can be implemented as a bonus game to an underlying slot game having a house advantage for both games in a range of 4% to 12%.

b. The FAMILY FEUD Gameshow Example

In this example, a slot machine is conventionally playing with a bonusing feature under the teachings of the present invention. Periodically, the player gets to participate in a bonus game based upon the conventional FAMILY FEUD game. It is to be expressly understood that no endorsement, affiliation or relationship whatsoever exists between the owners of the FAMILY FEUD game show and the inventor and/or assignee of the present invention. The FAMILY FEUD trademark is used in a factual sense to illustrate the teachings of the present invention.

As in the conventional game show, a question given to 100 people will be presented to the player. The top five answers will be shown (in random order) to the player. The player chooses the answer he/she thinks was most popular. The number of people (between 1 and 100) that gave the player's response is credited to the player.

For example, the query "We asked 100 men to name their favorite sport" might be accompanied by these "top 5" responses:

| | | |
|---|---|---|
| A) | Baseball | (25) |
| B) | Football | (40) |
| C) | Basketball | (20) |
| D) | Boxing | (7) |
| E) | Pro Wrestling | (3) |

The numbers in parenthesis would not be visible to the player as they represent the actual survey results. Thereafter, if the player correctly selected football, the player would be rewarded with 40 credits. Alternatively, if the player had picked basketball, the player would have received only 20 credits, since this answer was "correct" but not as popular.

For this question, a player with perfect knowledge has $B_{MAX}=40$ coins. A player with no knowledge has $B_{MIN}=\frac{1}{5}(25+40+20+7+3)=19$ coins.

In this case, each individual question may have a different top award, so the calculation for the theoretical $B_{MAX}$ needs to consider the individual $B_{MAX}$ for all the possible questions. $B_{MAX}$ for the bonus game would be the average of all the individual $B_{MAX}$ values. Similarly, $B_{MIN}$ for the bonus game is equal to the average of the individual $B_{MIN}$ values for each question.

To whit, $$B_{MAX}=1/N\ \Sigma B_{MAXindividual} \quad \text{FORMULA 7}$$

$$B_{MIN}=1/N\ \Sigma B_{MINindividual} \quad \text{FORMULA 8}$$

Where $B_{MAX}$ and $B_{MIN}$ are as before, $B_{MINindividual}$ and $B_{MAXindividual}$ represent the individual $B_{MIN}$ and $B_{MAX}$ values per question, and N=Number of Questions For example, assume the database comprises 1,000 queries with an average $B_{MAX}$=40 and average $B_{MIN}$=20. If f=0.03, X=5, and R=3.5, then a game with a minimum player's expectation of −18% (Formula 3) and a maximum player's expectation of −6% (Formula 4).

Alternatively, the game could function by providing five correct answers and two bogus answers. As long as the player avoids the bogus answers, he/she is awarded the appropriate credits corresponding to the chosen correct answer. The bonus game continues, and credits are accumulated, until the player selects a bogus answer or until all correct answers are chosen.

The bonus game could also function a different way. Instead of awarding the player a number of credits equal to the number of respondents who also picked the same answer, the paytable could consist of five fixed reward amounts (e.g., 50, 40, 30, 20, or 10 credits) depending on whether the player picked the $1^{st}$, $2^{nd}$, $3^{rd}$, $4^{th}$, or $5^{th}$ most popular answer, respectively. The game could also function with the player trying to select the least responded to answer, or the only response not said by anyone (i.e., a placebo response), and so forth.

C. TRIVIAL PURSUIT Game Example

In this example, a slot machine is conventionally played with a bonusing feature under the teachings of the present invention. Periodically, the player gets to participate in a bonus game based upon the conventional TRIVIAL PURSUIT game. It is to be expressly understood that no endorsement, affiliation or relationship whatsoever exists between the owners of TRIVIAL PURSUIT game and the inventor and/or assignee of the present invention. The TRIVIAL PURSUIT trademark is used in a factual sense to illustrate the teachings of the present invention.

As described above, several possible answers may be given in which the player must try to select the correct one. In keeping with the theme of the home game, the player may receive a bonus for correctly answering a question and additionally receive a "lammer" (e.g., pie piece) for that category (e.g., Science). Once lammers are collected for all six categories, the player enters a bonus round receives a final bonus or final question for a large potential bonus.

For example, consider a four-coin game in which the frequency is 0.04 for visiting a bonus game. In the bonus game, the player is initially assigned a random question from any of six random categories, together with two possible answers. On the next visit to the bonus, the player is assigned a random question from any of the remaining five categories, and so forth. For each category, a correct answer is worth 20 credits, while an incorrect answer is worth 10 credits. Upon facing all six categories (whether answered correctly or not), the player with the seventh visit is given a final question which is worth 200 coins if correct and 100 coins if incorrect. Regardless of the outcome of the seventh visit, the bonus game then resets.

In this case, a player with perfect knowledge will, each time upon entering the bonus game for the first six bonus games, earn 20 credits. The seventh bonus game will yield 200 credits for the final question. Thus, for one complete bonus cycle consisting of seven visits, the total number of credits won is 320. The equivalent $B_{MAX}$, per visit, is thus 320/7=45.71.

A player with no knowledge will, each time upon entering the bonus game, have a one-half chance of answering correctly, and a one-half chance of answering incorrectly. Each visit is thus worth ½ (20)+½(10)=15 credits. The final visit is worth an average of ½ (200)+½(100)=150 coins. Thus, for one complete bonus cycle, the player will earn, on average 240 coins in seven visits. The equivalent $B_{MIN}$, per visit, is roughly 240/7=34.29.

Assuming the value for R/X=0.55, the following are the values for the player's expectation:

$$PE_{MIN}=(2.2+0.04\times34.29-4)/4=-10.71\%$$

$$PE_{MAX}=(2.2+0.04\times45.71-4)/4=+0.71\%$$

Thus, in this game, the house has a minimum advantage of −0.71% (against perfect knowledge) and a maximum advantage of 10.71% (against no knowledge).

Clearly, other variations on this theme are possible. For example, instead of automatically progressing to the next category whether answering correctly or not, the bonus game could require that a category's question be answered correctly before progressing to the next category. Alternatively, instead of paying 10 credits for an incorrect answer, the bonus game might pay nothing, and so forth.

4. Various Algorithmic Models for Knowledge-Based Games

Clearly, many possible embodiments exist for knowledge-based games that could be utilized under the teachings of this invention. Several examples have already been described above.

a. Multiple Choice

The player can be allowed multiple guesses at the same question, up to a number of guesses equal to the number of possible responses (i.e., ensuring a correct answer ultimately). The multiple choice questions can have several correct answers (e.g., surveys). How this is calculated has already been shown in the above examples.

b. True/False

True/false answers are a multiple choice variation. Consider a true/false knowledge based game in which the player is given a statement and queried whether the statement is true or false. Assume the player is awarded an average to 50 credits for a correct answer, and zero points for an incorrect answer. In this case, the perfect-knowledge player's expected return is 50 credits, while that of a no-knowledge player is ½×50+½×0=25 credits. Clearly, the true/false knowledge based game need not be limited to zero points for an incorrect answer, but this example is illustrative in the sense of the type of query that may be asked.

c. Proximate Responses

One variation is to have a player guess a value and the closer a player gets to the correct answer, the more the potential reward is. An example might be the query, "How many miles is Boston from Washington, D.C.?" The pay schedule may be a function of how close the player got to the correct answer. E.g., if the player's response:

| | |
|---|---|
| Is within ± 10 miles | 100 credits |
| Is within ± 100 miles | 75 credits |
| All others | 50 credits |

A player with perfect knowledge would result in $B_{MAX}$=100. A player simply guessing would result in $B_{MIN}$=50. Alternate examples for proximity might include temperatures, prices, poll results, or other answers within a range. Furthermore, stipulations such as "player can't be higher than the answer" or "player can't be lower than the answer" can be put in place to add a further twist to the game.

d. Degrees of Difficulty

A series of questions can be presented to challenge players with superior knowledge. Thus, a player answering correctly may be rewarded and queried with another question of the same or greater difficulty, and so forth, until missing a question. For example, the payoffs as the player moves to the next level of difficulty can increase.

TABLE II

| | Payoff | |
|---|---|---|
| Level | Correct | Incorrect |
| Round I Question | 10 | 5 |
| Round II Question | 20 | 10 |
| Round III Question | 30 | 15 |
| * | * | * |
| * | * | * |
| Round N Question | J | K |

As shown in the above Table, players are encouraged to sit at the underlying game and continue to play so that they can move up in the question rounds to increase payoffs. Under the teachings of the present invention, each round can have the same house advantage for $B_{MAX}$ and $B_{MIN}$ (for example, by altering the frequency, f, of entering the bonus game) or the house advantage can change from round to round. In this case, the design approach is to consider the entire cycle.

e. Series of Questions

A quiz comprising, for example, seven questions, might be given and the player rewarded based on the number of correct answers.

For example, consider Table III. A player, upon entering a bonus round, is given a question. If incorrect, the player is rewarded with 5 coins and the bonus game ends. If correct, the player is given 10 coins and another question. If incorrect on the second question, the player is given an additional 10 coins and the bonus game ends. If correct on the second question, the player is given 20 additional coins and one last question. On the last round, a correct response garners 30 coins, while an incorrect response garners 15 coins.

TABLE III

| | Payoff | |
|---|---|---|
| Level | Correct | Incorrect |
| Round I Question | 10 | 5 |
| Round II Question | 20 | 10 |
| Round III Question | 30 | 15 |

In this case, $B_{MAX}$=60 coins. $B_{MIN}$=½(5)+½×½(10+10)+½×½×½(10+20+15)+½×½×½(10+20+30)=20.625 coins.

Alternatively, the player, at some point during the game, may be given the option to "double or nothing." For example, upon entering the game and correctly answering a question worth 20 credits, the player may "double or nothing" on the next question. In this case, $B_{MAX}$=40 credits, and so forth. The opportunity to risk a portion of one's winnings on the next question need not be limited to occurring after a correct response. Indeed, it may be initiated after an incorrect response, or immediately upon entering the game (e.g., the player is awarded 50 credits and the option to "double or nothing" by answering a question correctly).

f. Puzzles

Puzzles can also be provided in which logic and/or knowledge results in a known method of solution with no uncertainty. An example of a puzzle game is the well-known game of Nim. In the two-player game of Nim, a number N of separate piles each containing Cj elements, where j is an index from 1 to N, are used. The game can be played in several variations, the object of one of which is to be the individual to take the very last element. On one's turn, a player chooses a remaining pile x, and from that pile, can remove from 1 to Cx elements. Mathematically, it is well known that for any initial setup of N and Cj, an individual given the choice of going first or second, if playing optimally, will always win.

As another example, consider the game in which a single pile of N sticks is used. On one's turn, a player can remove from 1 to M sticks (where M is less than N). The game can be played with the object being to leave your opponent the last stick. If so, then the optimal strategy is to leave your opponent a number of sticks S, such that the quantity S−1 is evenly divisible by M+1. Thus, an individual given the choice of going first or second, if playing optimally, will always win.

As a casino game, the invention can utilize either of these puzzles in a format whereby the computer plays randomly, and the player is rewarded with X credits for winning the game and Y credits for losing. Alternatively, the computer, too, may play optimally. In still another embodiment, the player is awarded an amount of credits equal to the number of elements/sticks that he/she removed, plus a bonus should he/she win the game. Other variations will be evident to those familiar with this game, as will the calculation for $B_{MAX}$ and $B_{MIN}$ depending on the actual algorithm chosen.

A different type of puzzle game that is also conducive to this invention is tic-tac-toe. An optimal player in tic-tac-toe will never lose, whether going first or second. Thus, the object of the bonus game may be to play tic-tac-toe and at least draw. This can be achieved with certainty by a player with perfect knowledge regardless of the opponent's play. Clearly, the essential ingredient with a puzzle, when used as a knowledge-based game, is that some outcome is a certainty with proper play.

The puzzle may be two-player (as described above) or multi-player or solitary. An example of a solitary game might be the fitting of pieces of a puzzle together, or the Towers of Hanoi ring problem, perhaps with an associated timer. In principle, any puzzle with a known solution may be employed. A timer may be used to ensure the game is completed in a timely manner.

All of the knowledge-based games discussed above serve to illustrate the teachings of the present invention incorporating such games into a casino environment that is fair to the casino and to the player. Any knowledge-based game can be utilized and, therefore, the present invention is not limited to the game examples presented.

5. Stand-Alone Knowledge-Based Board Game

In Formula 1, for a stand-alone game, R=0 and f=1. Thus the house advantage for a stand-alone game is:

$$\text{House Advantage}=(X-B)/X \qquad \text{FORMULA 9}$$

Where:

X=Units Bet

B=Expected Return in Units

Again, the two extremes (a player with perfect knowledge and a player who simply guesses) guide the design of the stand-alone knowledge-based game of the present invention.

a. Example

Consider a knowledge-based game in which a multiple choice question is asked and seven responses are given, only one of which is correct. Assume the wager, X, is ten coins to participate. As the question is presented to a player, a prize is displayed for getting the question correct. The prize determination is random according to the following weighted matrix shown in Table IV:

TABLE IV

| Prize (Units) | Probability |
|---|---|
| 8 | 0.33 |
| 10 | 0.66 |
| 100 | 0.01 |

Should a player be incorrect on the first guess, the player is eligible to win ¾ of the displayed prize with a correct second, third, fourth, fifth, or sixth guess. If incorrect after six guesses, the wager, X, is lost. Should a player have perfect knowledge, then $B_{MAX}$=0.33×8+0.66×10+0.01×100=10.24 units. The corresponding House Advantage is (10−10.24)/10=−2.4%. That is, a player with perfect knowledge has a slight advantage over the house. A player with no knowledge, on the other hand, has a ⅐ chance of the displayed prize, a ⅚ chance of ¾ of the prize, and a ⅐ chance of 0. Therefore, the expected return of this player of $B_{MIN}$ is ⅐×10.24+⅚×7.68=6.95. The corresponding House Advantage in this case is about 30.5%. Certainly, many other prize structures are possible under the teachings of the present invention.

By utilizing the design criteria set forth above for the present invention, the stand-alone knowledge-based game can be incorporated into a casino environment which assures the casino a house advantage having a predetermined acceptable value, even when played by a player having perfect knowledge. For players with no knowledge and who simply guess, the house advantage is even greater.

6. Knowledge-Based Game Reward Varies from Game to Game

As in the example immediately above, the reward from game to game need not be the same. This is also true in all of the embodiments discussed above. Consider the PRICE IS RIGHT, FAMILY FEUD, and TRIVIAL PURSUIT conventional games discussed above. In one embodiment, each knowledge-based bonus game may be "worth" a fixed number of credits (e.g., one hundred credits). In this example, $B_{MAX}$ for a perfect player equals one hundred credits, and $B_{MIN}$ for a player with no knowledge is worth something less, such as Z credits. Hence, this game may be modified from time to time as follows. The bonus game may be "worth" one hundred credits 99% of the time, and one thousand credits 1% of the time, making the average value of $B_{MAX}$ for a player with perfect knowledge equal to 0.99×100+0.01×1000=109 credits. The same scaling factor is applicable for a player with no knowledge. Hence, $B_{MIN}$ for a player with no knowledge is now worth 1.09×Z credits. Many variations of this example are possible within the teachings of the present invention.

The value for a knowledge-based bonus casino game may be tied to the price of the object under consideration (i.e., guessing the price of a truck might be worth 1,000 credits, while guessing the price of a bottle of shampoo might be worth ten credits), but need not be. Indeed, in a limiting case, the value for a bonus game may be equal to the actual price (or a constant factor multiplied thereby) of the object under consideration.

7. Two-Level "Back and Forth" Knowledge-Based Game

The following is an example of this variation. The player plays an underlying (level 1) game of chance such as a slot machine. Each three-coin spin has an expected player return of two coins. On average, once every twenty games, the player randomly enters the secondary (level 2) knowledge-based bonus game.

In the knowledge-based game, the player wagers three coins per "play." Each play comprises a question and three answers. The player is rewarded in the following manner:

| | |
|---|---|
| Correct on first guess | five coins |
| Correct on second guess | four coins |
| Correct on third guess | three coins |

Hence in knowledge-based games, the player clearly has a positive expectation, even with no knowledge. A perfect knowledge player has $B_{MAX}$=5 coins for a net win of two coins per secondary game, while a no knowledge player who simply guesses has $B_{MIN}$=4 coins for a corresponding net win of one coin per game.

On average, after every ten knowledge-based games, the control reverts back to the underlying slot machine. Thus, on average, a player with perfect knowledge gains twenty coins (10×2) during the secondary sequence, while losing twenty coins (20×1) during the underlying sequence, leading to a house advantage of 0% for the combined game. On the other hand a player with no knowledge gains ten coins (10×1) during the secondary sequence, while losing twenty coins during the underlying game. Hence, the house advantage against this player is ⅔(+⅓)+⅓(−⅓) =⅑=+11.1%. Many variations on this example are possible within the teachings of the present invention.

As another example of back and forth play between an underlying game and a bonus game, assume the game begins with the player in New York City. The player, upon the first visit to the bonus game, must answer a query regarding New York City. For example, it may be a true/false question with an award of 50 credits if correct, and 30 credits if incorrect. If the player is correct, he immediately advances to the next city, which may be random or predetermined. Whether correct or not, play returns to the base game. Upon the next visit to the bonus game, the player must answer a query regarding the current city. For example, if the current location is Buffalo, the question may relate to Niagara Falls. Assume that there are a total of five cities including the original and ultimate destination, and that the player (after answering five questions correctly, hence finishing the journey) is awarded a bonus of 100 credits.

In this case the player with perfect knowledge will require only one visit to each city to complete the journey. The entire journey will be worth 5×50+100=350 credits and take 5 bonus game visits. Hence, on average, each visit to the bonus round garners 70 credits.

The player with no knowledge will require, on average, two visits to each city to get a correct response. Hence, the entire journey will take 10 bonus game visits and be worth 5×80+100=500 credits. On average, each visit to the bonus round garners 50 credits.

In another variation, the player's query would be chosen randomly upon visiting the bonus game, rather than immediately after answering a query correctly. So, for example, after correctly answering New York City, the next visit to the bonus game might have the following sequence occur: randomly select the proposed next city (e.g., one of Buffalo, Boston, and Atlantic City) and query the player. If the player is correct, he moves to the appropriate city. If incorrect, he stays in New York. Upon the next visit to the bonus game, a random city is chosen relative to the player's current location.

The two-level game can also utilize a varying reward as described above. It can also utilize a secondary knowledge-based game in which an additional wager is not required.

8. Method of Operation

What has been described in the foregoing sets forth novel methods for a knowledge-based bonus game in combination with an underlying casino game, a stand-alone knowledge-based casino game, and a back-and-forth casino game based upon a conventional game of chance and a knowledge-based game.

Figure 2:
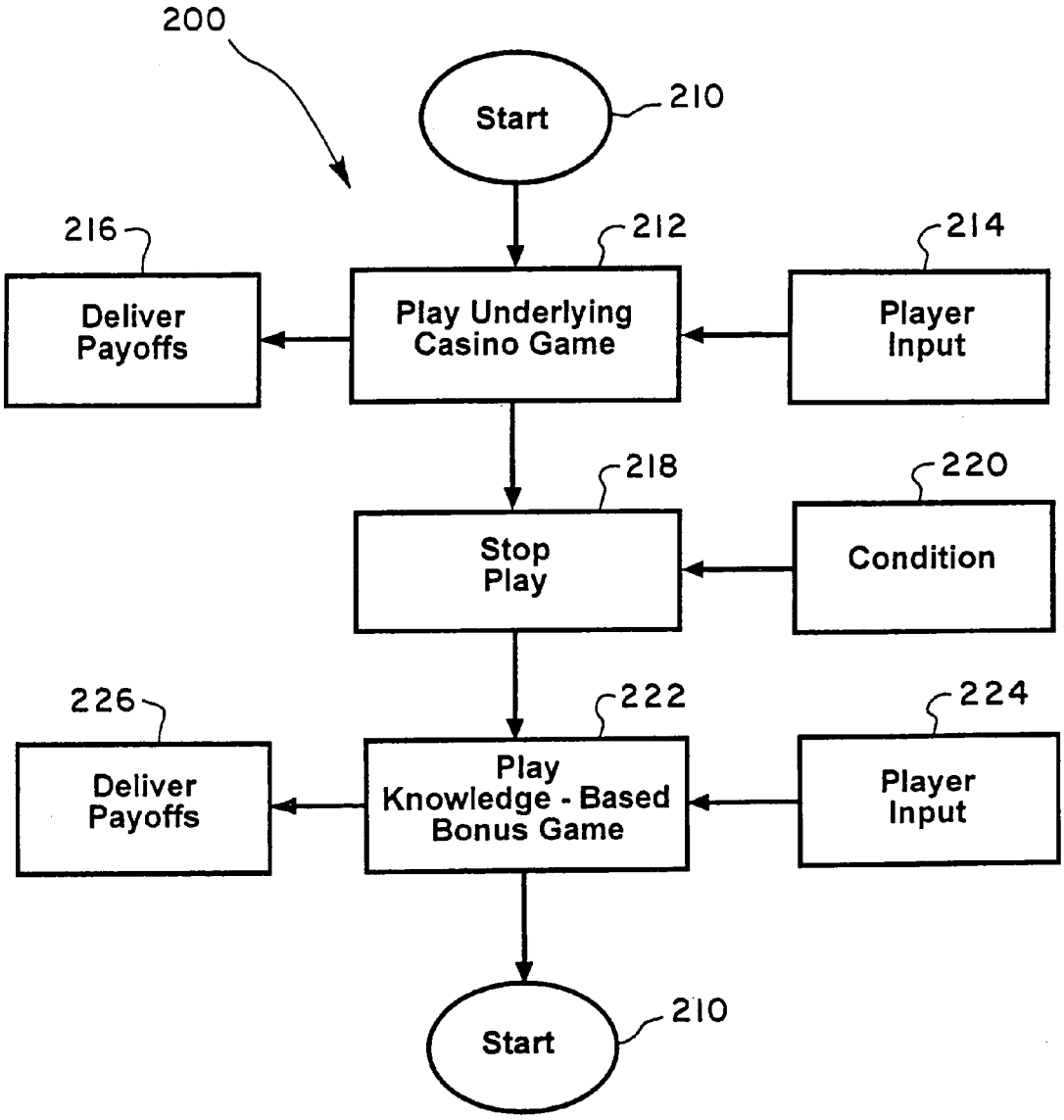
FIG. 2 is a functional flow diagram of the knowledge-based bonus casino game of the present invention.

A method 200 has been presented herein, as shown in FIG. 2, for a new casino game wherein an underlying game of chance is provided. The underlying casino game of chance can be any conventional casino game (whether automated or live) such as, but not limited to, slots, joker poker, live card games, dice, wheel games, etc. The underlying casino game is conventionally started in stage 210 such as by receiving a wager or the like and played in stage 212 from a player accessing the game of chance through conventional input devices in stage 214. In a conventional fashion, this would include placing wagers, playing the underlying casino game of chance according to the rules of the game, and receiving awards (payoffs), if any, based upon the placed wagers in stage 216. The delivered awards (payoffs) occur in stage 216 and the play of the underlying game in stage 212 provides an initial expected return, therefore, a first House Advantage to the casino. The play of the underlying game of chance is preferably stopped in stage 218 upon the occurrence of a condition in stage 220. In the preferred embodiment, the stoppage of the play of the underlying casino game occurs randomly with an overall statistical given frequency. What causes the underlying casino game to stop may be based upon a condition occurring before, during or after the play of the underlying casino game (for example, a bonus game symbol occurring on a slot line), based upon a condition occurring unrelated to the play of the game (for example, a random set timer timing out), etc. The triggering event may also be a random coin-in. For example, immediately after a bonus game, a random number between 100 and 150 may be selected. Each credit wagered on the base game increments a coin-in meter; when the coin-in meter reaches the random number, the bonus game is triggered. Alternately, the bonus event may be invoked by means separate from the base game or bonus game. For example, a random roll of two electronic "dice" may be used with each play of the base game, with a total of 2 (a 1 in 36 occurrence) used to trigger the bonus game.

Playing the knowledge-based bonus game occurs in stage 222. The present invention may or may not require an additional wager from the player along with the occurrence of the condition to play the bonus game. The player plays the bonus game in stage 222 through conventional input devices in stage 224 which may or may not be the same input devices used in stage 214. Such input devices are conventional in the gaming industry and may comprise touch screens, keyboards, microphones, mouse inputs, switches, etc. Likewise payoffs in the bonus game stage 222 are delivered in stage 226 which may or may not use the same payoff devices as found in stage 216. Such payoff devices are conventional in the gaming industry and include credit meters, coin-out, tickets, entries on smart cards, etc. The actual delivered payoffs in stage 226 are determined under the teachings of the present invention along with the payoffs in stage 216 provides a House Advantage that varies in a set range dependent upon the knowledge of the player in stage 222. The knowledge-based bonus game can be based on any algorithmic game model such as, but not limited to questions having multiple choice answers in which only one of the multiple choices is correct or in which at least of the multiple choices is correct. Or, the knowledge-based game could be based on a question requiring a proximate answer or a puzzle having a forced outcome. In truth, it is to be expressly understood that the game algorithmic model selected can be any game which is knowledge-based. Several examples have been set forth above, but such examples by no means limit the nature and type of the algorithmic knowledge-based game model.

After play is completed in stage 222, play returns to the start stage 210. When the combined knowledge-based bonus game and underlying casino game is considered as a whole, the resulting House Advantage for any given player is within a predetermined range. One end of the range occurs when a player with perfect knowledge always answers all queries in the knowledge-based bonus game correctly. When this occurs, the House Advantage in the range is at least a first set limit determined by the casino according to the teachings of the present invention. Likewise, when a player simply guesses at the queries to the knowledge-based game, the House Advantage is at most a second set limit of the range. In one embodiment of the present invention, the method pays a player a first amount for the correct answer and pays the player a second amount for an incorrect answer. This provides a positive feedback to the player in playing the bonus game since even if the player is wrong, the player receives a payback. In this embodiment of the method, the player continues to play the underlying casino game since when the bonus round occurs, a larger payout is made for the correct answer during the bonus round and, even if incorrect, the player receives a payback. In another embodiment, when the player is wrong nothing is paid.

Figure 3:
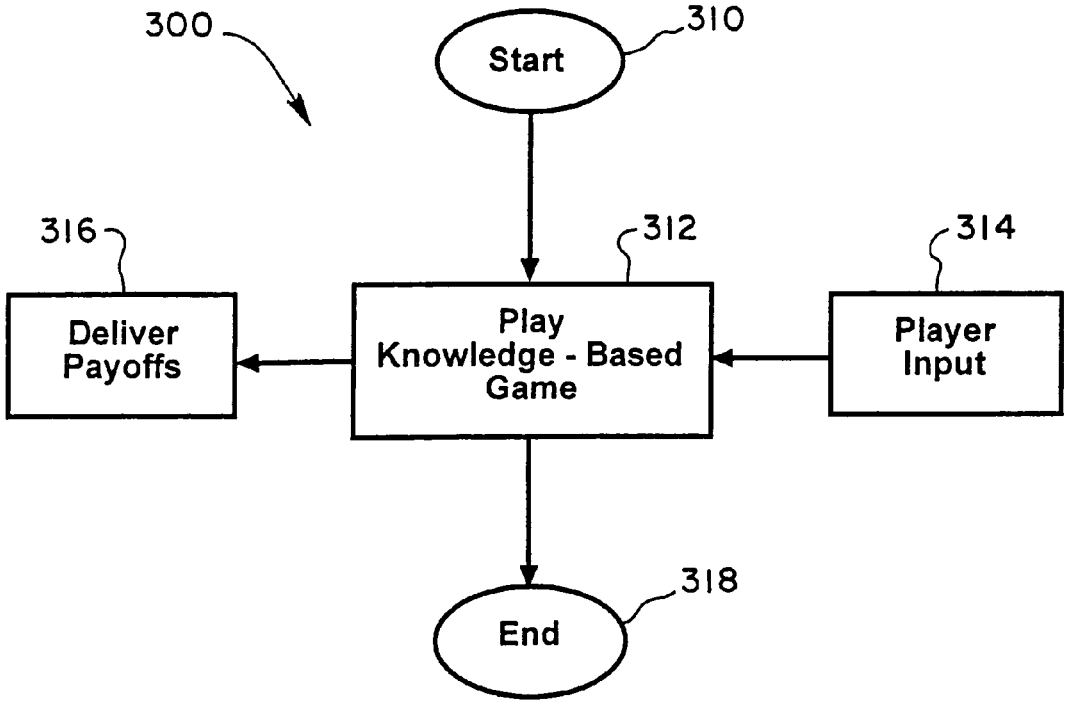
FIG. 3 is a functional flow diagram of the knowledge-based stand-alone casino game of the present invention.

The method 300 for playing the stand-alone knowledge-based casino game of the present invention shown in FIG. 3 is designed to receive a wager from a player to start in stage 310 play of the knowledge-based stand-alone game. The players provide at least one answer in the knowledge-based game in stage 314. One or more queries could be provided in stage 312 to play the game. The method of the present invention then receives an answer from the player in stage 314 in response to the at least one provided query. The method of the present invention, based upon the teachings set forth above, provides a House Advantage for the knowledge-based standalone game within a predetermined range. The predetermined range, as discussed above for the bonus game, is based upon a player correctly answering all queries and a player simply guessing in response to the queries. These two types of players determine the predetermined range as discussed above. Finally, the method of the present invention for the knowledge-based stand-alone game pays the player in stage 316 based upon the received wager in stage 310, the at least one answer from the player in stage 314 and the House Advantage. Again, how a wager is received, how a player is paid, what type knowledge-based game is used can be any of a number of equivalent approaches.

Figure 4:
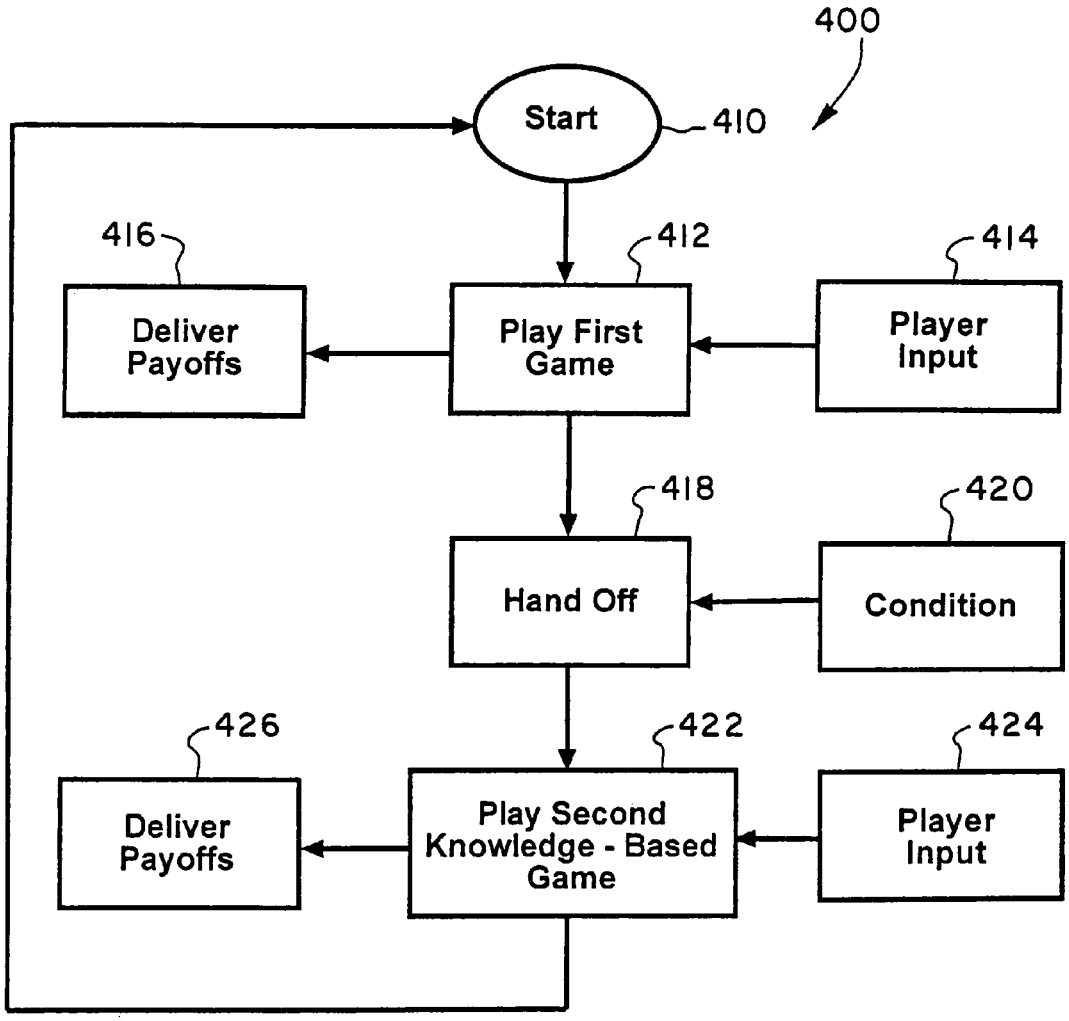
FIG. 4 is a functional flow diagram of the back-and-forth games of the present invention.
Figure 5:
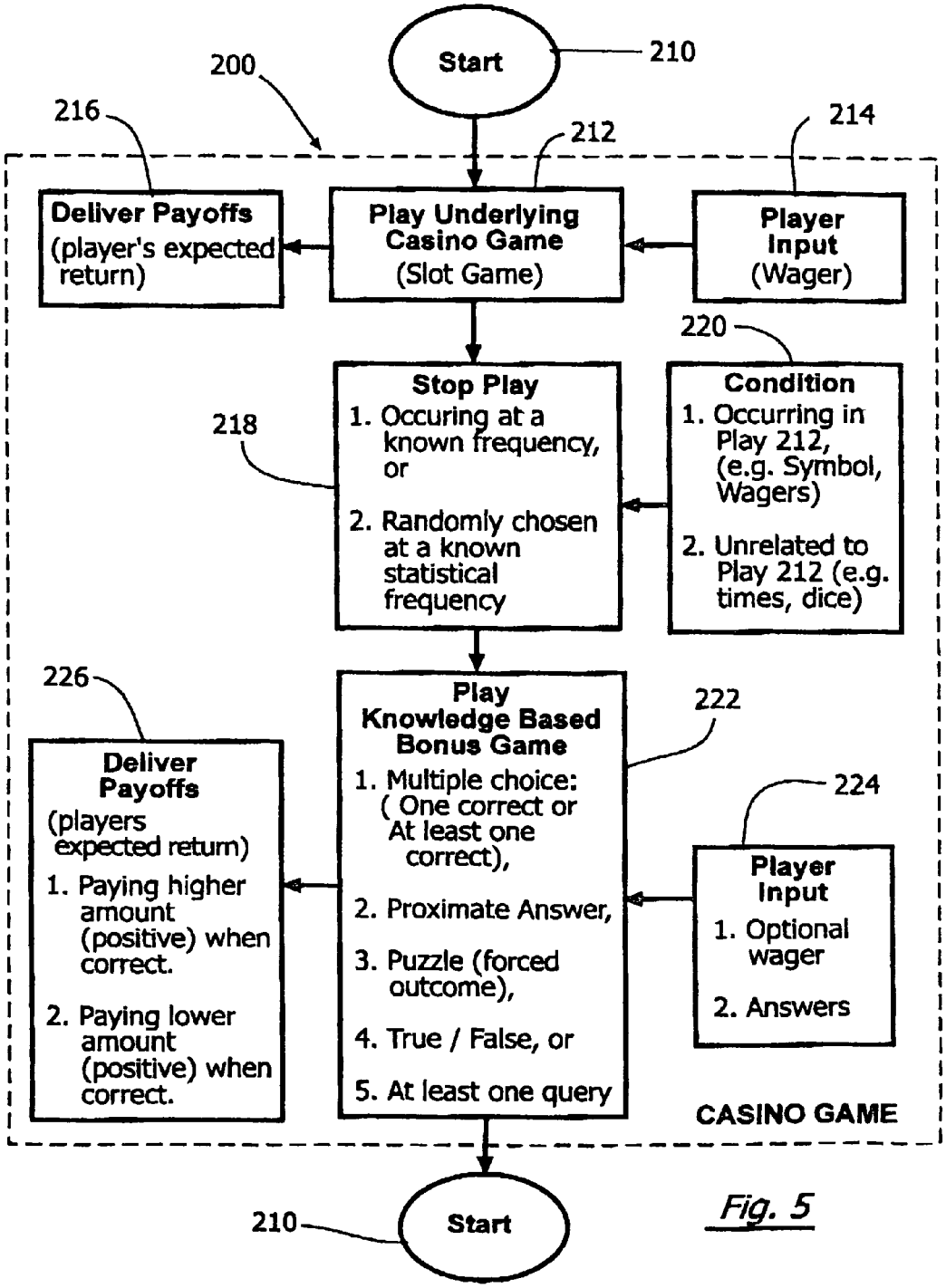
FIG. 5 is a functional flow diagram of the knowledge-based bonus game of the present invention based on FIG. 2 and showing greater detail.
Figure 6:
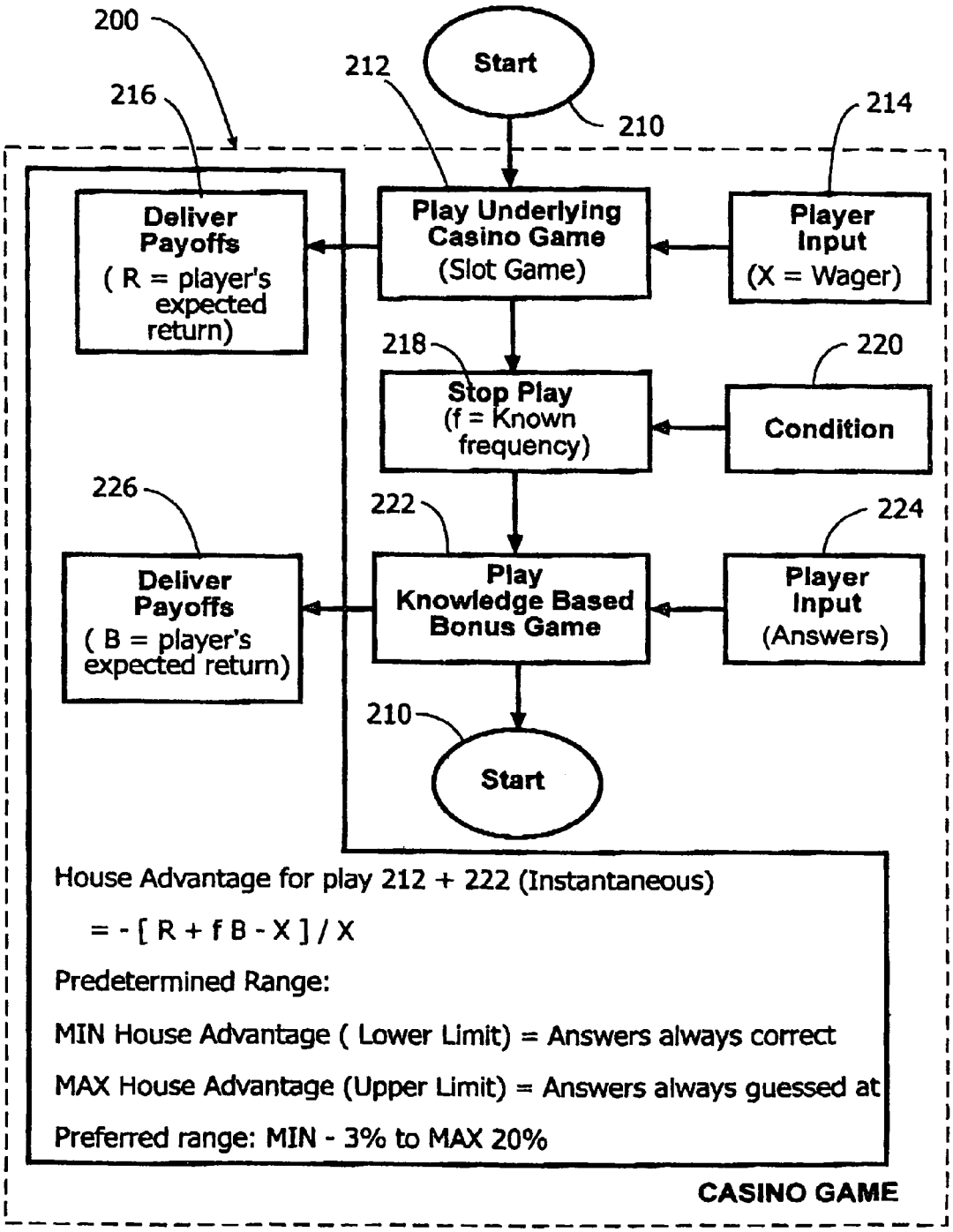
FIG. 6 is a functional flow diagram of the knowledge-based bonus game of the present invention based on FIG. 2 and showing house advantage detail.

Finally, the method 400 of the present invention in FIG. 4 provides a new casino game wherein play between a first game and a second knowledge-based game occurs. The first game starts in stage 410 when the player conventionally places a wager play occurs in stage 412 based upon player input received in stage 414. In the first game, the player has a negative player expectation and, therefore, as payouts are delivered over time in stage 416, the House Advantage is positive. Upon stopping of the play of the first game upon a condition occurring in stage 420, the second knowledge-based game is entered through the handoff stage 418. To commence play of the second game may or may not also require an additional wager in stage 418. The play of the second game commences in stage 422 with player knowledge-based responses given in stage 424 and payoffs in stage 426. The second knowledge-based game has a positive player's expectation. It may comprise one or multiple queries, and may, for example, continue until the player answers incorrectly one or more times. Hence, when both player's expectations in both games are considered, the overall House Advantage again falls within a range based upon a player correctly answering all queries and based upon a player simply guessing at all queries in the play of the second game in stage 422.

It is to be expressly understood that all of the methods set forth above are functional descriptions of the present invention which can be programmed into a conventional microprocessor such as any of those commercially available personal computers available in the marketplace. Furthermore, the design, construction, and operation of casino games are well known.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

I claim:

1. A method for playing a casino game comprising:

receiving a wager from a player in the casino game to play an underlying game of chance and a survey-based bonus game;

playing the underlying game of chance in the casino game in response to receiving the wager;

paying the player, in the casino game, a game of chance award when the player wins during play of the underlying game of chance, the game of chance award at least based on the received wager;

ending the casino game in response to paying the game of chance award;

upon occurrence of a random bonus event in the casino game, presenting to the player in a display of the survey-based bonus game a survey question and a plurality of responses to said survey question by a number of people surveyed;

receiving at least one input in the survey-based bonus game from the player responsive to said presented survey question, said at least one input including at least one of said plurality of responses;

paying the player, in the casino game, a bonus award, the value of the bonus award at least a function of how many people in said number of people provided the at least one of said plurality of responses included in said at least one input received from the player, the bonus award awarded separately from the game of chance award; and ending the casino game in response to paying the bonus award.

2. The method of claim 1 wherein said playing said underlying game of chance comprises playing a slot game.

3. The method of claim 1 wherein said presenting to the player in the display comprises:

presenting said question and said plurality of responses according to an output of a randomly set timer.

4. The method of claim 1 wherein said paying said bonus award comprises:

paying the player a bonus award having a value in credits equal to how many people provided said at least one response included in said at least one input from said player.

5. A casino game comprising:

an underlying game of chance for play by a player of said casino game upon receiving a wager from said player;

a game of chance award in said underlying game of chance payable to said player when said player wins during said play of said underlying game of chance, the game of chance award at least based on the received wager;

a survey-based bonus game for play by said player upon being triggered in said underlying game of chance;

an initiation mechanism for triggering said play of said survey-based bonus game;

a database having a plurality of survey questions, a plurality of responses for each survey question, and a number of people providing each of the plurality of responses for each said survey question, one of said plurality of survey questions with its plurality of responses presented to said player in a display upon said triggering of said survey-based bonus game from said initiation mechanism;

at least one input to the survey-based bonus game from the player responsive to said displayed survey question with its plurality of responses, said at least one input including at least one of the displayed plurality of responses; and a bonus award payable to said player in said survey-based bonus game, the value of said bonus award being a function of at least the number of people providing the at least one response corresponding to said at least one input from the player, said bonus award being paid separately from said game of chance award.

6. The casino game of claim 5 wherein the underlying game of chance is a slot game.

7. The casino game of claim 5 wherein said initiation mechanism is random.

8. The casino game of claim 5 wherein said initiation mechanism is a randomly set timer.

9. The casino game of claim 5 wherein said survey question and said plurality of responses pertain to sporting events.

10. A method for playing a casino game comprising:

receiving a wager from the player in the casino game to play an underlying game of chance and a survey-based bonus game;

playing the underlying game of chance in the casino game in response to receiving the wager;

paying the player, in the casino game, a game of chance award when the player wins during play of the underlying game of chance, the game of chance award at least based on the received wager;

upon occurrence of a triggering event in the casino game, presenting the player, in a display, with a survey question and a plurality of accompanying survey responses from a database in the casino game, said plurality of accompanying survey responses including at least one correct response and at least one bogus response;

receiving at least one input to the survey-based bonus game from the player responsive to said presented survey question, said at least one input including at least one of said plurality of accompanying survey responses;

continuing said receiving until either:

(a) all correct responses are received in the casino game from the player, or (b) a bogus response is received in the casino game from the player, whichever of (a) or (b) occurs first; and paying the player a bonus game award in the casino game, said bonus game award paid separately from said game of chance award.

11. The method of claim 10 wherein said paying said bonus game award comprises:

paying the player a bonus game award having a value in credits equal to a number of respondents providing said at least one correct survey response to the survey question that is included in said at least one input.

12. The method of claim 10 wherein said paying said bonus game award comprises:

paying the player a bonus game award fixed according to a rank of said at least one included correct survey response in said presented accompanying survey responses.

13. The method of claim 10 wherein said presenting comprises:

presenting said survey question and said accompanying survey responses upon the occurrence of a random bonus event.

14. The method of claim 10 wherein said presenting comprises:

presenting said survey question and said responses upon an expiration of a randomly set time period.

15. The method of claim 10 wherein said playing said underlying game of chance comprises:

playing a slot game.

16. The method of claim 10 wherein said presenting comprises:

presenting a survey and a plurality of accompanying responses relating to sporting events.

17. The method of claim 10 further comprising storing said database in a computer memory.

* * * * *